United States Patent [19]

Vieweg

[11] 4,321,591

[45] Mar. 23, 1982

[54] PORTABLE, SELF-POWERED MULTIPLE WARNING DEVICE

[76] Inventor: Thomas Vieweg, 1089 N. Corona Ave., Valley Stream, N.Y. 11735

[21] Appl. No.: 118,764

[22] Filed: Feb. 5, 1980

[51] Int. Cl.[3] ..... G08B 19/00; G04C 23/12

[52] U.S. Cl. ..... 340/521; 340/541; 340/546; 340/628

[58] Field of Search ..... 340/509, 521, 522, 541, 340/546, 628, 629, 630

[56] References Cited

U.S. PATENT DOCUMENTS 4,093,944 6/1978 Muncheryan ..... 340/521

*Primary Examiner*—Alvin H. Waring

*Attorney, Agent, or Firm*—Herbert L. Lerner; Laurence A. Greenberg

[57] ABSTRACT

Portable, self-powered multiple warning device, including an alarm clock, a smoke or gas detector, a common power source for powering the alarm clock and smoke or gas detector, first warning means for issuing an activation signal for the alarm clock and second warning means for issuing an activation signal for the smoke or gas detector.

11 Claims, 7 Drawing Figures

PORTABLE, SELF-POWERED MULTIPLE WARNING DEVICE

The invention relates to a portable self-powered multiple warning device and more particularly to such a device having an alarm clock and a smoke or gas detector and/or burglar alarm.

Portable alarm clocks, powered by a spring winding or by batteries are well known in the art, as are smoke detectors and burglar alarms which are powered by batteries or alternating house current. Lately clock radios with smoke and gas sensors have become available, but these are powered by alternating house current and are not self-powered or portable in that the user must have a wall receptacle nearby to power the device.

Although a person may have the convenience and protection of an alarm clock, smoke or gas detector and burglar alarm in separate units in his house, a traveler would have needed to carry a separate battery-powered or wind-up alarm clock, battery-powered smoke or gas detector and battery-powered burglar alarm with him when he traveled. Furthermore, the latter two devices were only made to be permanently installed in a building, and their performance after constant movement could not be assured.

It is accordingly an object of the invention to overcome the hereinafore mentioned disadvantages of the heretofore known devices of this general type, and to provide a portable, self-powered multiple warning device which can be used for travel where alternating house current is not available. It is a further object to provide a device which can be used where house current of different voltages are found, or in a boat, auto, motor home or camper which might not have alternating house current available.

With the foregoing and other objects in view there is provided, in accordance with the invention, a portable, self-powered multiple warning device, comprising an alarm clock, and/or a smoke or gas detector, and/or a burglar alarm, a common power source for powering the burglar alarm, alarm clock and smoke or gas detector, first warning means for signaling activation of the alarm clock, second warning means for signaling activation of the smoke or gas detector and third warning means for signaling activation of the burglar alarm. It is therefore possible to use existing battery-powered devices, including a spring-powered clock, and combine them into one unit without constructing new components expressly for use in the new portable device.

In accordance with another feature of the invention, each of the warning means are combined into a single warning unit. In this way, conventional components can be combined without the separate warning devices which they all normally use. By using a common warning unit, costs are greatly reduced.

In accordance with a further feature of the invention, the combined warning unit includes means for issuing different warnings for each warning means. In this way, when a person is awakened, he will instantly know if the clock has gone off, if there is smoke or fire in the room, or if a burlary has occurred.

In accordance with an added feature of the invention, the common power source includes a 9 volt transistor battery and means for regulating voltage fed to the alarm clock to 1.5 volts. This makes it possible to use commonly available smoke or gas detectors which operate on 9 volt transistor batteries and commonly available alarm clocks which operate on 1.5 volt batteries.

In accordance with an additional feature of the invention, the common power source includes means for transforming 110–120 volt alternating current to regulated direct current. It is therefore contemplated to use one or more house current-components with non-house current-components.

In accordance with yet an another feature of the invention, the clock includes a winding and the common power source includes a generator connected to the winding. In this way a device is provided which operates solely on a manually wound spring. No batteries which may wear out are used.

In accordance with yet a further feature of the invention, the common power source includes a storage battery being recharged by the generator and a regulator and filter connected to the storage battery. This feature allows a storage battery to be used, but gives it a longer life through a recharging system.

In accordance with yet an additional feature of the invention, the combined unit includes a dual voltage control oscillator, a 2 to 1 data selector multiplexer, and a speaker, and the different warnings are different frequency sounds emanating from the speaker.

In accordance with yet an added feature of the invention, there is provided a housing surrounding the device. Thus the device is self-enclosed and self-powered, needing no external power or permanent installation.

In accordance with still another feature of the invention, the combined warning unit includes signal relay means, a dual voltage controlled oscillator connected to the signal relay means, and a specifier connected to the oscillator, and the different warnings are different frequency sounds emanating from the speaker.

In accordance with a concomitant feature of the invention, the combined warning unit includes a voltage regulator generating an intermittent signal, a plurality of AND gates each receiving the intermittent signal and one of the activation signals, relay means connected to the AND gates for receiving the activation signals and issuing distinguishable signals, a dual voltage-controlled oscillator connected to the relay for receiving the distinguishable signals, and a speaker connected to the oscillator for receiving the distinguishable signals and issuing the different warnings as different frequency sounds.

Other features which are considered as characteristic for the invention are set forth in the appended claims.

Although the invention is illustrated and described herein as embodied in a portable, self-powered multiple warning device, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
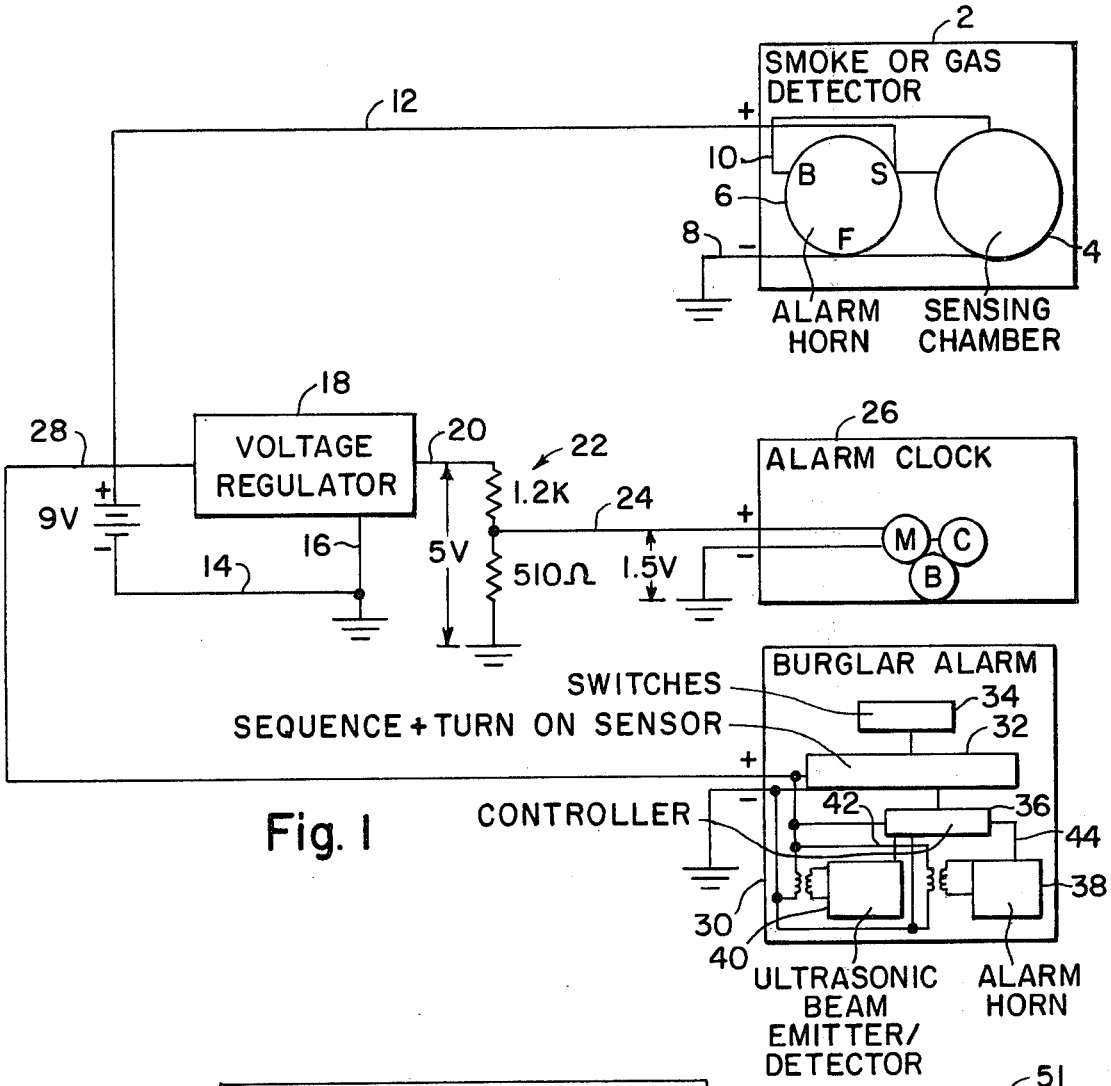
FIG. 1 is a schematic and block circuit diagram for the combined alarm clock, smoke or gas detector and burglar alarm having a common power source, of the invention, with a 9 volt power source.

Referring now to the figures of the drawing and first particularly to FIG. 1 thereof, there is seen a group of three components powered by a common power source. The smoke or gas detector 2 may be any one of several conventional, readily available units, such as First Alert model No. SA 76 RC, that is shown in the drawing. Such smoke or gas detectors commonly include a sensing chamber 4 which senses smoke, heat or hydrocarbon vapors, and a warning means such as an alarm horn 6 of conventional construction, each having three terminals thereon. Such devices also are available with testing units, so that the operability of the device may be checked before use. As can be seen in FIG. 1, one terminal of the sensing chamber 4 and the terminal F of the alarm horn 6 are commonly connected to a negative ground by a line 8. The terminal B of the alarm horn 6 is further connected to a second terminal of the sensing chamber 4 by a line 10. Finally, a positive line 12 is commonly connected to the terminal S of the alarm horn 6 and to a third terminal of the sensing chamber 4. The line 12 is connected at the other end thereof to the positive terminal of a 9 volt battery, as shown. The negative terminal of the battery is connected to ground over a line 14 and to a line 16 leading to a voltage regulator 18. The voltage regulator may, for example, be a National Semiconductor model No. LM 109 which gives an output of 1.5 volts, but this merely represents one possible alternative.

When the LM 109 voltage regulator is used, it is fed to a voltage divider 22 over a line 20. The voltage divider may include, for example, a 1.2k and a 510Ω resistor connected to ground, giving a voltage output of 1.5 v as illustrated in FIG. 1. The voltage divider is topped off with a line 24 leading directly to the positive terminal of the step motor (M) of a conventional battery operated alarm clock 26, which includes a clock (C) and a warning means of bell (B), and may operate on 1.5 volts. For example, PICCO brand quartz clock with an alarm, model No. P-k 607-1, may be used. A clock radio may also be used in lieu of an alarm clock.

A third line 28 extends from the voltage regulator 18 to a burglar alarm 30. The burglar alarm 30 may also be any of several available devices, such as General Electric Zonar burglar alarm model No. 8250-003, which is powered on by 9 volt battery.

The burglar alarm 30 includes a standard group of components which can be found in other such devices with little change. The device 30 illustrated in FIG. 1 will not be discussed in detail except to state that an ultrasonic beam emitter/detector 40 sends out signals which are normally returned. When an intruder is present the return signals are altered which causes an alarm to be given by the alarm horn 38. Switches 34 are present in the device for controlling a sequence and turn on sensor 32 which is fed by line 28 and is connected to a negative ground as shown. A controller 36 is connected to the emitter/detector 40, and to the alarm horn 38 by a line 44. The alarm horn is also connected through a transformer to a line 42 as illustrated in FIG. 1.

Figure 2:
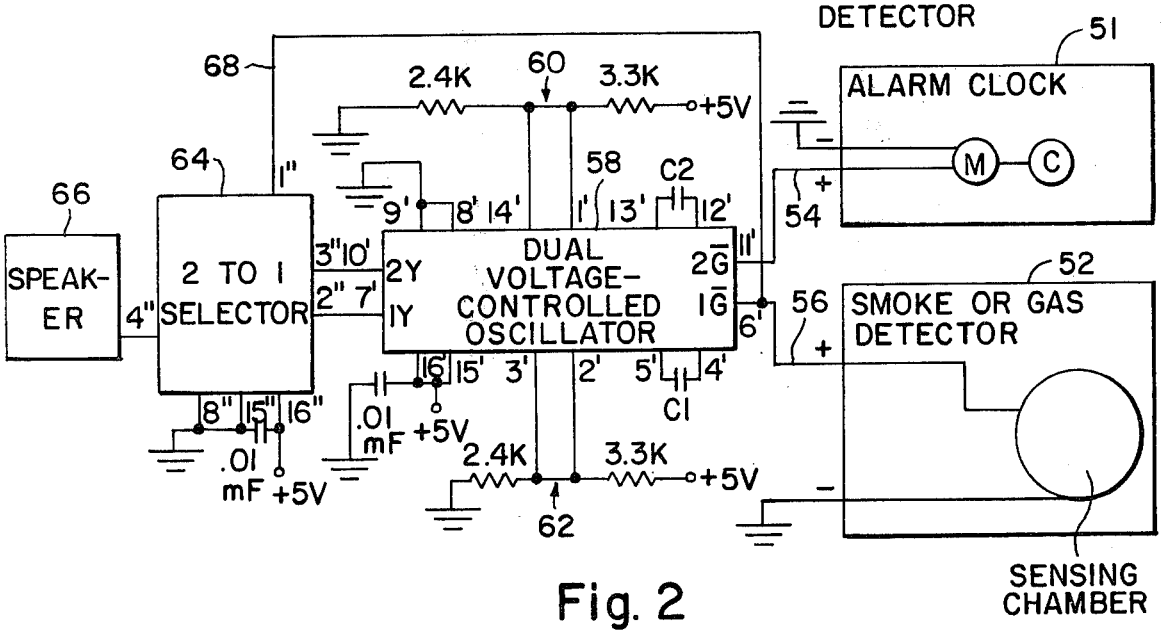
FIG. 2 is a schematic and block circuit diagram for the alarm clock and smoke or gas detector, including a common alarm sounding device.

FIG. 2 illustrates a circuit for an alarm clock and a smoke detector which not only have a common power source, but a common warning unit or alarm device as well. It is understood that in lieu of the smoke or gas detector 52 shown in FIG. 2, a burglar alarm may be used, or a combination of the two. Only the smoke or gas detector 52 is shown in FIG. 2 for the sake of simplicity. The smoke or gas detector 52 may be the same type as the unit 2 shown in FIG. 1 with the alarm horn removed, or it may be a similar unit which was manufactured without an alarm horn and is consequently less expensive. Naturally, the burglar alarm unit would also not include an alarm device but could be the same as, or similar to, the unit 30 shown in FIG. 1 in other respects. Similarly, the alarm clock 51 does not include a bell.

When the burglar alarm 30 of FIG. 1 is used in the FIG. 2 circuit instead of the smoke or gas detector 52, the alarm horn 38 is removed, or a device is preferably purchased without an alarm horn, and the line 56 and the connection to ground in FIG. 2 are connected to the lines 42 and 44 in the device 30, instead of the horn 38. Naturally, it is understood that the appropriate power systems for the components of FIG. 2 are supplied conventionally or as in FIG. 1.

Both the alarm clock 51 and smoke or gas detector 52 of FIG. 2 have one lead connected to a negative ground. The negative lead of the clock 51 is connected directly to the motor as shown and the negative lead of the detector 52 is connected to the same terminal of the sensing chamber that the line 8 in FIG. 1 was connected to. A positive lead 54 and a positive lead 56 of the clock and detector are connected to terminals 11′ and 6′, respectively, of a dual voltage control oscillator 58, which includes two independent voltage control oscillators (VC0). The control oscillator may again be any one of a number of suitable units, but Texas Instruments model No. SN 54 LS 124 is specifically illustrated. This unit has a plurality of numbered terminals which have been shown in FIG. 2 of the drawing of the instant application, with the addition of a prime (′) after each number to avoid confusion with reference numerals. Capacitors C1 and C2 establish the output frequency and are therefore connected between terminals 4′ and 5′, and terminals 12′ and 13′, respectively, for frequency control and frequency range. The oscillators can operate at any frequency between 0.12 HZ and 30 MHZ. Terminals 1′ and 14′ on the one hand, and terminals 2′ and 3′, on the other hand are connected to identical voltage dividers 60 and 62, respectively, each having a 2.4k and a 3.3k resistor connected between a +5 volt source and ground. As is clearly seen, both terminals 8′ and 9′ are connected to ground, while terminals 15′ and 16′ are connected to a +5 volt source and through a 0.01 mf capacitor to ground.

Terminals 7′ and 10′ are connected to terminals 2″ and 3″, respectively, of a quadruple 2-line-to-1-line data selector/multiplexer 64, which is simply referred to as a 2 to 1 selector in the drawing. The 2 to 1 selector 64 may again be one of several commercially available units. However, the Texas Instruments model SN 54 L 157 has been illustrated in the drawing, with the addition of a double prime (″) after the terminal numbers which actually appear on the device. Terminal 4″ of the 2 to 1 selector is fed to a speaker 66 which sounds the alarm triggered by the clock 51 or the detector 52. It is furthermore contemplated that a siren, or a light or any other kind of warning signal device could be used in place of the speaker 66. Finally, it is seen that the terminals 8″ and 15″ of the 2 to 1 selector 64 are connected to ground, while terminal 16″ is connected to a +5 volt source and to terminal 15″ through a 0.01 mf capacitor, and a line 68 is fed from the terminal 6′ to the terminal 1″. As explained hereinafore, the fact that there are two independent VCO units in the dual voltage control oscillators provides a different output frequency fed to the speaker 66, from the clock 51 and from the detector 52. Accordingly, a different sound will be heard from the speaker 66 depending on whether the alarm clock or the detector has caused the signal. In this way, a user of the device instantly knows which unit has signaled. Additionally, an intermittant interruption device of conventional type can be used on one or both of the signals fed to the speaker from the clock and detector, to distinguish between the alarms or warnings. Therefore, the dual voltage control oscillator, 2 to 1 selector and speaker together form a combined warning unit.

Alternate devices are usable in place of the circuit shown in FIG. 2. It is contemplated to use a single oscillator in which the frequency varies and a speaker; or multiple oscillators with a multiplexer and speaker; or multiple oscillators with multiple speakers.

Figure 3:
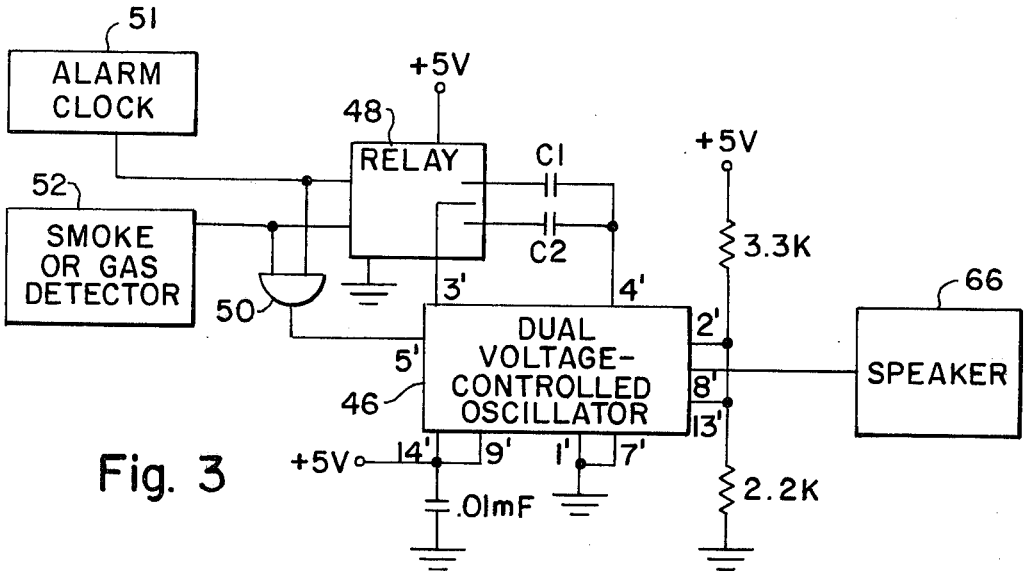
FIG. 3 is a schematic block circuit diagram similar to FIG. 2, showing a preferred second embodiment of a common alarm sounding device.

FIG. 3 illustrates a second embodiment example to be used in place of the circuit of FIG. 2.

Similar devices in FIG. 3 to those shown in FIG. 2 have the same reference numerals. In this preferred embodiment, the alarm clock 51 and smoke or gas detector 52 (which could also be the burglar alarm 30 as explained above) are generally shown as connected to a standard relay 48 that is in turn connected to ground. The relay controls the sound fed to the speaker 66 through a dual voltage-controlled oscillator 46 which is again one of several possible devices, but is illustrated as Texas Instruments model No. SN 54 LS 324. The oscillator 46 is again shown with the actual terminals found thereon with the addition of a prime (′). Two capacitors C1 and C2 are connected between the terminal 4′ and the relay 48 which is further connected to terminal 3′ of the oscillator 46. The capacitors control the frequency of the sound emitted by the speaker 66 depending on which device, 51 or 52, sends a signal through the gate 50 to terminal 5′. Further, connections to +5 volt sources of the relay 48, the terminals 14′ and 9′ and 2′, 8′ and 13′ through resistors to ground, are also shown in FIG. 3. Additionally, terminal 14′ is connected through a 0.01 mf capacitor to ground and terminals 1′ and 7′ are directly connected to ground.

Figure 4:
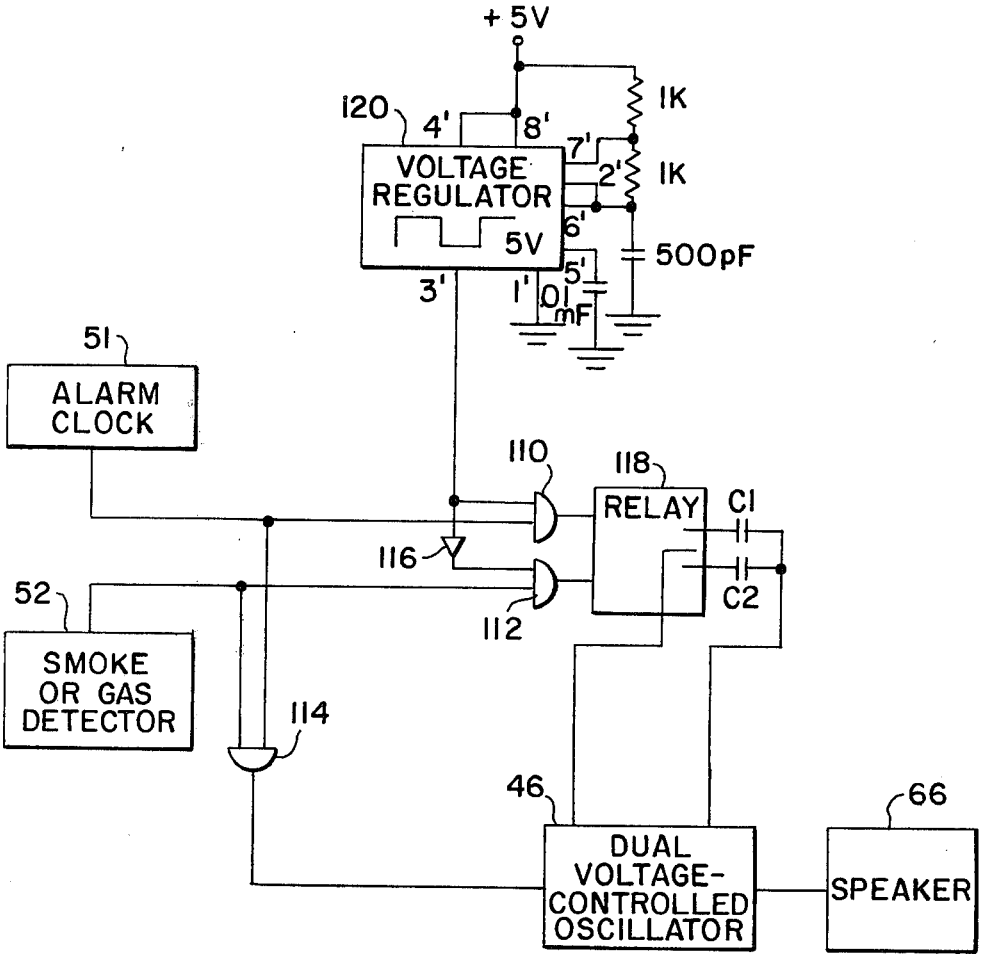
FIG. 4 is a block circuit diagram of a circuit for a combined alarm sounding device for eliminating cross talk.

The dual VCO units of FIGS. 2 and 3 may produce cross talk. However, in FIG. 4 there is seen a circuit which eliminates the cross talk problem. The alarm clock 51 and smoke or gas detector 52 (and/or burglar alarm) which each have a separate non-illustrated power supply or the power supply circuit of FIG. 1, are the same devices shown in FIGS. 2 and 3. Each device is fed through a NOR gate 114 to the dual voltage-controlled oscillator 46, which is the same unit used in FIG. 3. The oscillator 46 itself is powered by the power supply that is fed to the devices 51 and 52, but otherwise is connected as in FIG. 3. The alarm clock 51 and smoke or gas detector 52 are fed to AND gates 110, 112, respectively and then to a relay 118. The second inputs of the AND gates 110, 112 are fed from terminal 3′ of a voltage regulator 120. The voltage regulator 120 may again take the form of any one of several known devices, but the National Semiconductor model No. LM 555 is specifically illustrated in FIG. 4, with the actual terminals found on the device being shown with the addition of a prime (′) for clarity. The regulator 120 is fed by a +5 volt power source through terminals 4′ and 8′, and through a voltage divider having two 1k resistors connected through a 500 pF capacitor to ground, to terminal 7′. Terminals 2′ and 6′ are connected between the aforementioned resistors and capacitor, terminal 5′ is connected through a 0.01 mF capacitor to ground and finally terminal 1′ is connected to ground. An inverter 116 is furthermore connected in the line from the terminal 3′ between the inputs thereof to the AND gates 110, 112. In a similar way to that shown in FIG. 3, the output of the oscillator 46 is connected to the contact of the relay 118 and the output of the relay 118 is fed through capacitors C1 and C2 back to the oscillator. The capacitors C1 and C2 again determine the frequency of the sound emitted from the speaker 66 that is connected to the oscillator 46. The FIG. 4 circuit operates as follows: A square wave having a 5 V amplitude is generated in the regulator 120 and is conducted to the AND gates 110 and 112. When the positive portion of the wave is transmitted, a "1" signal is present at the gate 110 and a "0" signal at the gate 112 which receives its signal through the inverter 116. When the square wave is at zero, the signals at the gates 110 and 112 are reversed. If a signal is received for the alarm clock 51 because the set time has been reached, the necessary AND condition is met at gate 110 when a "1" signal is sent from the regulator 120 and a signal is received at the NOR gate 113 connected to the oscillator 46. When the signal from the regulator 120 switches to "0" then the AND condition at the gate 110 is no longer met. Therefore, an intermittent signal is fed to the capacitor C1 when the alarm clock goes off and the speaker 66 gives an intermittent sound in accordance with the frequency determined by the capacitor C1. In a similar manner, the smoke or gas detector gives a different intermittent signal through the capacitor C2 and the speaker 66, so that the user of the device instantly knows which device is sending an alarm by the frequency of the sound which can vary greatly as desired. Furthermore, because the invertor 116 inverts the signal fed to the AND gate 112 by the regulator 120, any signal sent through capacitor C2 from gate 112 will alternate in time with a signal which could be sent through gate 110 and capacitor C1. If the extremely rare occurrence of both devices signalling an alarm simultaneously should happen, then different frequency sounds would alternatingly be emitted from the speaker 66 to indicate an alarm condition from both devices.

It is of course contemplated here that cross talk could be eliminated by using two sets of speakers so that the signals do not interfere. The circuits of FIGS. 2 and 3 accomplish the goal of having one common combined warning unit, but cross talk can occur if the alarm clock should go off at the same instant that the smoke or gas detector and/or burglar alarm goes off. The FIG. 4 circuit eliminates this possibility.

Figure 5:
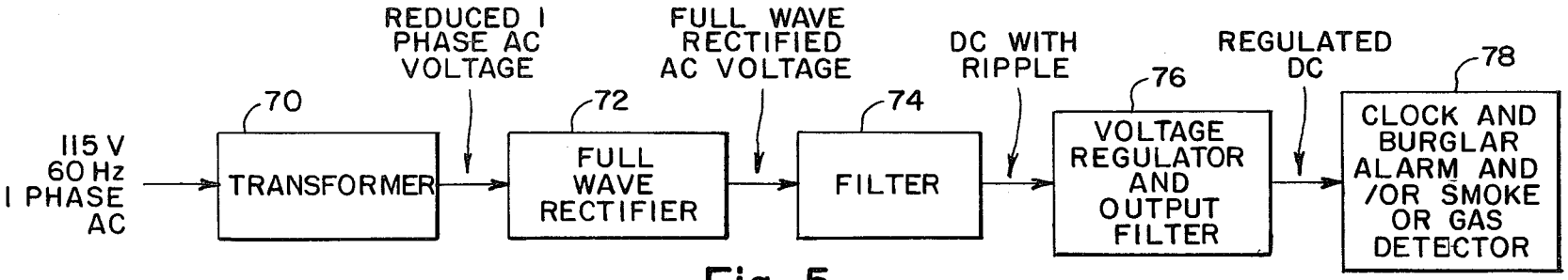
FIG. 5 is a block flow diagram of a circuit for powering the clock and smoke or gas detector with line current.

FIG. 5 shows a block diagram of a circuit for powering the clock and burglar alarm and/or smoke detector 78 with 115 volt 60 HZ single phase alternating house current. The a-c is fed to a transformer 70 which produces a reduced single phase a-c voltage. A full-wave rectifier 72 removes half of the voltage curve and produces full wave rectified a-c voltage. The filter 74 produces d-c with a ripple, that is fed to a voltage regulator and output filter 76 which produces regulated d-c that is fed to the devices 78.

Figure 6:
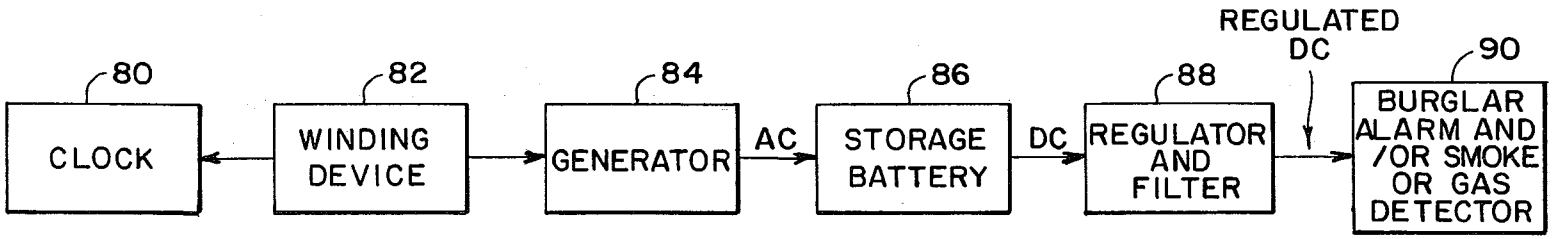
FIG. 6 is a block flow diagram of a circuit and device for powering the burglar alarm and smoke or gas detector with the winding of the alarm clock.

FIG. 6 illustrates an embodiment of the device in which the burglar alarm and/or smoke detector 90 is powered off the winding of a clock 80. The winding device 82, which can be a spring or a motor, turns the clock 80 and a generator 84 that produces a-c to recharge a battery 86. The a-c is fed to the storage battery 86 which in turn feeds d-c to a regulator and filter 88. Finally, the regulator and filter 88 feeds regulated d-c to the devices 90.

Figure 7:
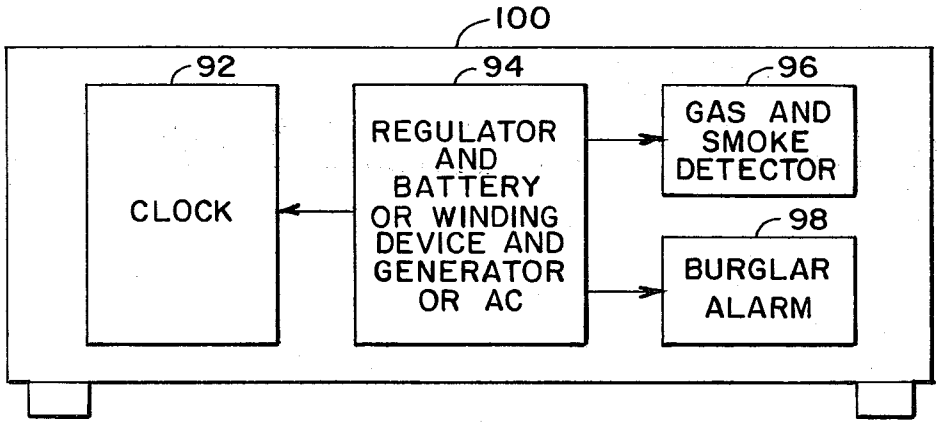
FIG. 7 is a diagrammatic view of an assembly of a clock, smoke or gas detector, burglar alarm and the possible alternative powering means, in one unit.

FIG. 7 shows the combination of the voltage regulator and battery or winding device and generator or a-c supply 94 used as a common power supply, powering the clock 92, the gas and smoke detector 96 and the burglar alarm 98, in a housing 100.

There are claimed:

1. Portable, self-powered multiple warning device, comprising an alarm clock, a smoke or gas detector, a common power source for powering said alarm clock and smoke or gas detector, first warning means for issuing an activation signal for said alarm clock and second warning means for issuing an activation signal for said smoke or gas detector, said warning means being combined into a single warning unit issuing different warnings for each warning means.

2. Portable, self-powered multiple warning device, comprising an alarm clock, a burglar alarm, a common power source for powering said alarm clock and burglar alarm, first warning means for issuing an activation signal for said alarm clock and second warning means for issuing an activation signal for said burglar alarm, said warning means being combined into a single warning unit issuing different warnings for each warning means.

3. Device according to claim 1, including a burglar alarm powered by said common power source, and third warning means of said warning unit for issuing an activation signal for said burglar alarm.

4. Device according to claim 1, 2 or 3, wherein said common power source includes a 9 volt transistor battery and means for regulating voltage fed to said alarm clock to 1.5 volts.

5. Device according to claim 1, 2 or 3, wherein said common power source includes means for transforming 110–120 volt alternating current to regulated direct current.

6. Device according to claim 1, 2 or 3, wherein said clock includes a winding and said common power source includes a generator connected to said winding.

7. Device according to claim 6, wherein said common power source includes a storage battery being recharged by said generator and a regulator and filter connected to said storage battery.

8. Device according to claim 1, 2 or 3, wherein said combined warning unit includes a dual voltage control oscillator receiving said activation signals, a 2 to 1 data selector multiplexer connected to said oscillator, and a speaker connected to said selector, and said different warnings are different frequency sounds emanating from said speaker.

9. Device according to claim 1, 2 or 3, including a housing surrounding the device.

10. Device according to claim 1, 2 or 3, wherein said combined warning unit includes signal relay means receiving said activation signals, a dual voltage controlled oscillator connected to said signal relay means, and a speaker connected to said oscillator, and said different warnings are different frequency sounds emanating from said speaker.

11. Device according to claim 1, 2 or 3, wherein said combined warning unit includes a voltage regulator generating an intermittent signal, a plurality of AND gates each receiving said intermittent signal and one of said activation signals, relay means connected to said AND gates for receiving said activation signals and issuing distinguishable signals, a dual voltage-controlled oscillator connected to said relay for receiving said distinguishable signals, and a speaker connected to said oscillator for receiving said distinguishable signals and issuing said different warnings as different frequency sounds.

* * * * *